US005462036A

United States Patent [19]

Kugler et al.

[11] Patent Number: 5,462,036

[45] Date of Patent: Oct. 31, 1995

[54] IGNITION SYSTEM FOR INTERNAL COMBUSTION ENGINES

[75] Inventors: Karl-Heinz Kugler, Vaihingen; Walter Gollin, Moeglingen; Karlheinz Riedel, Vaihingen; Christian Zimmermann, Pleidelsheim, all of Germany

[73] Assignee: Robert Bosch GmbH, Stuttgart, Germany

[21] Appl. No.: 211,578

[22] PCT Filed: Jul. 22, 1993

[86] PCT No.: PCT/DE93/00646

§ 371 Date: May 26, 1994

§ 102(e) Date: May 26, 1994

[87] PCT Pub. No.: WO94/03724

PCT Pub. Date: Feb. 17, 1994

[30] Foreign Application Priority Data

Aug. 8, 1992 [DE] Germany ..... 42 26 246.1

[51] Int. Cl.[6] ..... F02P 15/10; F02P 3/045; F02P 9/00

[52] U.S. Cl. ..... 123/609; 123/637; 123/644

[58] Field of Search ..... 123/606, 609, 123/625, 637, 644

[56] References Cited

U.S. PATENT DOCUMENTS

| | | | |
|---|---|---|---|
| 3,926,557 | 12/1975 | Callies et al. | 123/606 |
| 3,945,362 | 3/1976 | Neuman et al. | 123/606 |
| 3,976,043 | 8/1976 | Canup et al. | 123/637 X |
| 4,003,354 | 1/1977 | Canup | 123/606 X |
| 4,091,787 | 5/1978 | Frank | 123/606 |
| 4,112,890 | 9/1978 | Manger et al. | 123/606 |
| 4,933,861 | 6/1990 | Allen et al. | 123/644 |

FOREIGN PATENT DOCUMENTS 1586649 3/1981 United Kingdom .

*Primary Examiner*—Tony M. Argenbright
*Attorney, Agent, or Firm*—Kenyon & Kenyon

[57] ABSTRACT

An ignition system for internal combustion engines with sequential spark ignition is provided which serves to ensure that the last individual spark (EZ) of a sequential spark ignition does not lead to damage to the internal combustion engine, for instance damage caused by ignition during the exhaust stroke. A closing time corresponding to a charging process (AL) for an individual ignition is subtracted from a distribution limit (VG) to obtain a calculated limit (11). Once this limit is reached, the current charging process proceeds unimpeded to trigger the individual ignition, but no new charging process will be started.

10 Claims, 2 Drawing Sheets

IGNITION SYSTEM FOR INTERNAL COMBUSTION ENGINES

BACKGROUND OF THE INVENTION

An ignition system for internal combustion engines for the production of sequential spark ignitions is known from Federal Republic of Germany Patent 23 40 865. A sequential spark ignition is an ignition at the desired firing time calculated by the control device but the sparks of which, are not allowed to burn out entirely. Instead, the coil is recharged utilizing the residual energy and ignites again.

This process is repeated until the distribution limit is reached. The distribution limit is the crankshaft angle which a firing time of the last ignition of a sequential spark ignition must not exceed. If the distribution limit is exceeded, then there is a danger that, with the high voltage distribution at rest, the ignition spark may fall within the exhaust stroke, or that, with rotating voltage distribution, the high voltage available may be imparted to the spark plug of the next cylinder. In both cases this would have a negative influence on the travel behavior of the internal combustion engine. Therefore, until now, the charging process of the last individual ignition of a sequential spark ignition has been interrupted upon reaching the distribution limit.

SUMMARY OF THE INVENTION

In accordance with the present invention, in addition to the distribution limit, a further crankshaft angle is introduced which is obtained by subtracting the closing angle corresponding to a charging process of an individual ignition from the angle of the distribution limit. In this way, the charging process of the last individual ignition of the sequential spark ignition can, in all cases, be completed so that the energy stored is sufficient for the triggering of an ignition spark. As a result, the starting of a charging process which would be interrupted upon reaching the distribution limit regardless of how full the coil was charged is avoided. This means that no unnecessary losses of energy occur. At the same time, since the primary current in the ignition coil is detected, a disconnecting of the primary current takes place only when the energy stored is sufficient to produce an ignition spark under normal conditions. The control device of the internal combustion engine can continue, by detection of the supply voltage, to adapt the closing time of each individual ignition of the sequential spark ignition in accordance with the conditions of the internal combustion engine, so that a disconnection of the primary current is effected only when the energy stored in the ignition coil produces an ignition spark on the spark plug under normal operating conditions.

DETAILED DESCRIPTION OF THE INVENTION

Figure 1:
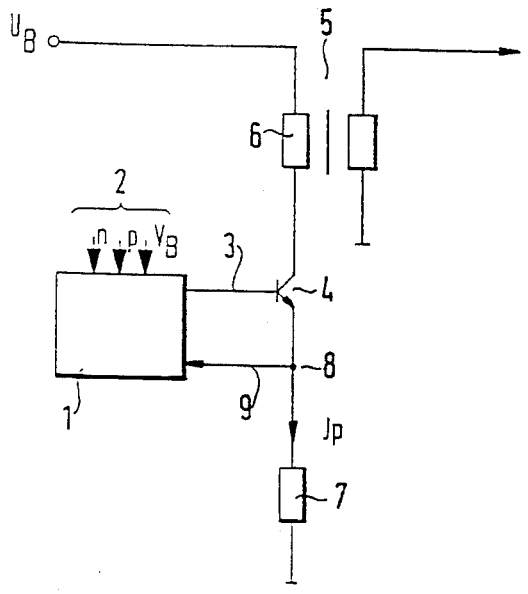
FIG. 1 shows the construction in principle of an ignition system.

FIG. 1 shows an ignition system of an internal combustion engine. A control device 1, for instance a microprocessor, detects various operating parameters of the internal combustion engine, such as speed of rotation n, pressure p, supply voltage $U_B$, temperature T, etc. as input variables 2 in order to determine the ignition time ZZP. Via a connection 3 of the control device 1, the ignition transistor 4 is actuated for the connecting and disconnecting of the flow of current in the ignition coil 5. The ignition transistor 4 is connected on the collector side to the supply voltage $U_B$ via a series connection with the primary winding 6. On the emitter side, the ignition transistor 4 is connected to ground via a current shunt 7. Between the emitter of the ignition transistor and the current shunt 7, there is a tap 8 from which, via a connection 9 in the control device 1, a voltage which is proportional to the primary current $I_p$ is detected during the driving of the control transistor 4.

Figure 2:
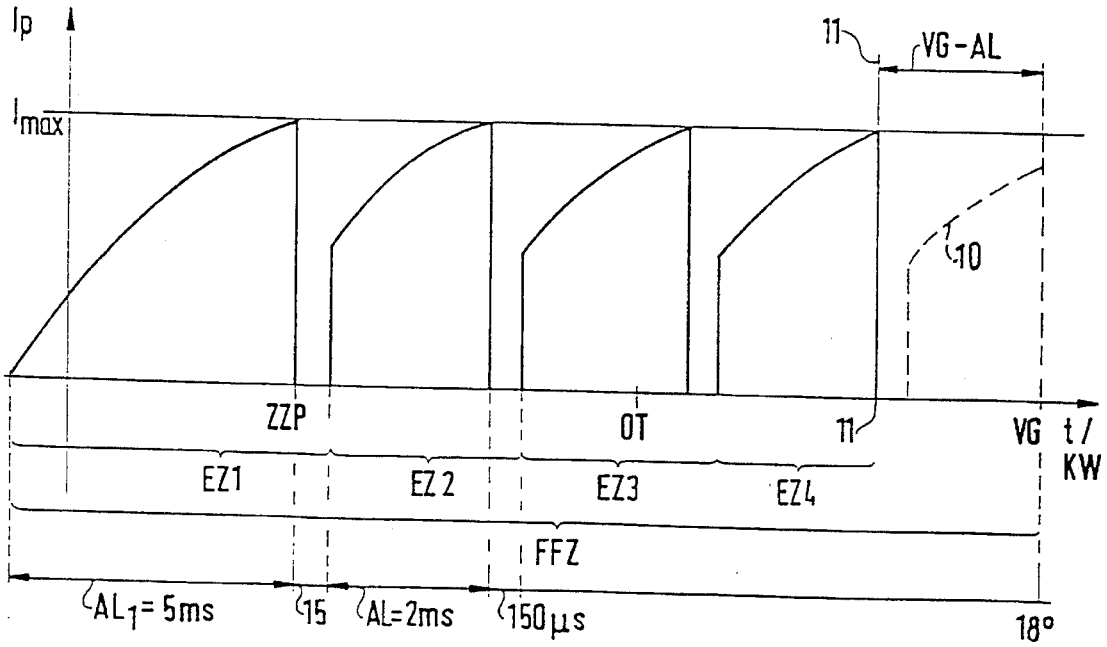
FIG. 2 shows the charging processes of the individual ignitions of a sequential spark ignition plotted over the corresponding time range or the range of the crankshaft angle within which the sequential spark ignition takes place.

FIG. 2 shows the variation with time of the primary current $I_p$ during the individual ignitions EZ of a sequential spark ignition FZZ over the range of the crankshaft angle within which the sequential spark ignition is triggered. The course of the primary current is also shown, over the time t, with respect to the top dead center OT. After reaching the firing time ZZP, for instance 10° crankshaft angle before top dead center (OT), the first individual ignition EZ1 is triggered by the control device. In this connection it is possible, by the detection of the primary current $I_p$ in the control device, to trigger the ignition only when a predeterminable maximum value $I_{max}$ has been reached. In this way, the energy stored in the ignition coil is guaranteed to be sufficient under normal operating conditions for an ignition spark. After interruption of the charging process AL of the first individual ignition EZ1, the ignition spark burns until the reconnection of the ignition coil current for the second individual ignition EZ2. This process is repeated four times in the embodiment shown, so that the sequential spark ignition FFZ is formed for four individual ignitions EZ1 to EZ4.

On the crankshaft-angle or time axis there is illustrated the distribution limit VG at which the sequential spark ignition FFZ is interrupted in order to prevent destruction of the ignition system. The distribution limit VG in the embodiment of FIG. 2 lies at 18° crankshaft angle after top dead center OT. The dashed line 10 indicates the charging process AL of the last individual spark ignition. In this connection, it can be clearly noted that the charging process AL is not sufficient to reach a predetermined value of the primary current $I_{max}$ so that an ignition spark is produced under normal operating conditions. The charging process of an individual ignition is, for instance, dependent on the parameters of the ignition coil or the instantaneous operating conditions. The charging process of the first individual ignition is in this case about 5 ms and the charging process of the following individual ignitions AL1 is 2 ms. The charging process of the first individual ignition EZ1 of a sequential spark ignition FFZ is longer than the charging process AL of the following individual ignitions. This is due to the fact that, upon the charging process of the first individual ignition EZ1, under normal conditions no residual energy is present in the ignition coil, while in the case of the following individual ignitions the ignition spark does not burn out completely by the reconnecting of the ignition coil and thus residual energy is still stored in the ignition coil. Therefore, in accordance with the present invention in addition to the distribution limit VG, another limit value 11 is introduced, which is determined by subtracting a charging process AL from the distribution limit VG. A charging process at the coil which has already been introduced at 11 is still brought to an end and still ignited. However, if no charging has started, i.e. the additional limit 11 coincides with the open time, which amounts for instance to 15 μs, no charging and therefore no individual ignition EZ is started. As a result, the last individual ignition EZ of a sequential spark ignition FFZ is carried out with the maximum possible spark energy—in the example shown in FIG. 2, this is the individual ignition EZ4.

The rise of the primary current $I_p$ and thus the energy stored in the ignition coil is dependent on the parameters of the ignition coil and also on the supply voltage $U_B$. Therefore, the supply voltage $U_B$ is also to be taken into consideration in the determination of the duration of the charging process AL.

Figure 3A:
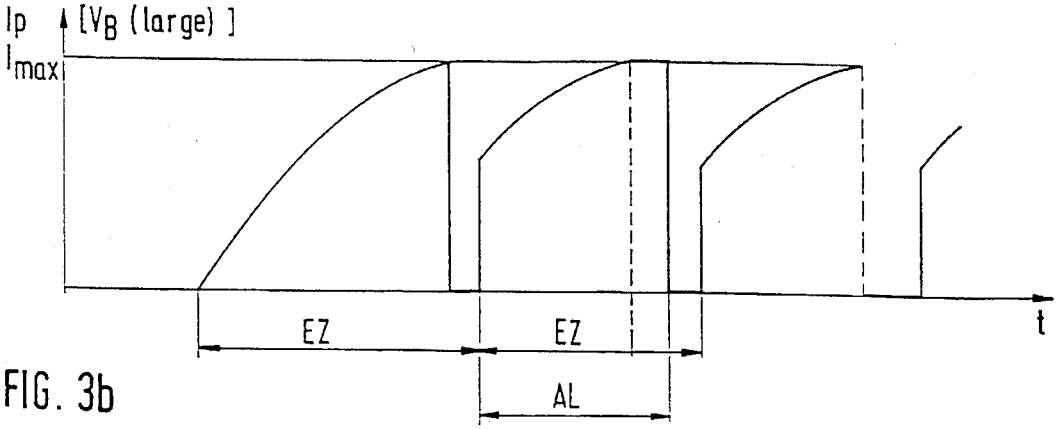
FIG. 3(*a–c*) shows the charging processes of the individual ignitions with different supply voltage.
Figure 3B:
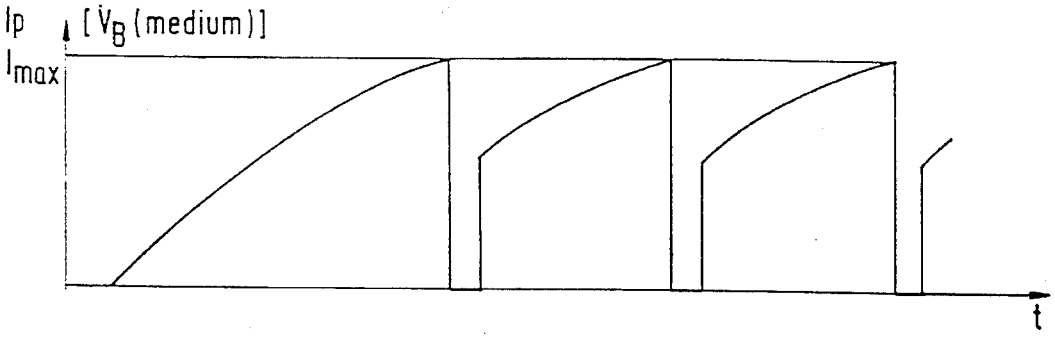
Figure 3C:
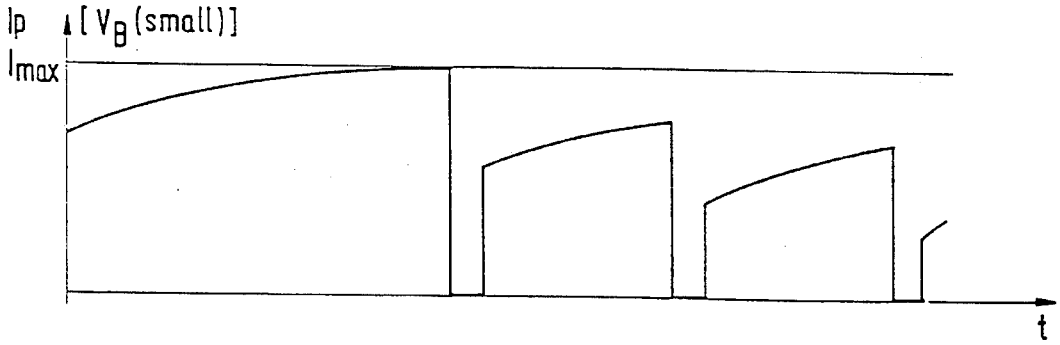

FIGS. 3*a*, 3*b* and 3*c* show the course of the primary current $I_p$ for individual ignitions EZ as a function of the supply voltage $U_B$, the course of the primary current in the case of a high supply voltage $U_B$(large) being shown in FIG. 3*a*, course in the case of medium supply $U_B$(medium) in FIG. 3*b*, and the course of a small supply voltage $U_B$(small) in FIG. 3*c*. The rise of the primary current $I_p$ with the same supply voltage $U_B$ is the same for all charging processes AL with this supply voltage.

Each of FIGS. 3*a* to 3*c* shows the course of the primary current of, in each case, three individual ignitions. In this connection it can be noted that in the case of the individual ignitions of FIG. 3*a*, and therefore with large supply voltage $U_B$(large), a predeterminable maximum value of the primary current $I_{max}$ is reached within a shorter time t than predetermined (AL) than in the case of the individual ignitions of FIG. 3*b*, while the maximum value $I_{max}$ of the primary current $I_p$ in the case of too low a supply voltage $U_B$(small) is—as can be noted from FIG. 3*c*—not reached at all with fixed predetermined charging time A1. The second individual ignition of FIG. 3*a* shows that the primary current $I_p$ has already reached the maximum value $I_{max}$ for an ignition under normal operating conditions before the end of the charging process AL. In order to avoid unnecessary losses, an interruption of the charging process could be brought about by the control device already upon the reaching of the maximum value $I_{max}$, and therefore at $I_p=I_{max}$. Thus, for instance, the third individual ignition in FIG. 3*c* shows a shortened charging process.

In order to exclude the above deficiencies, the supply voltage is in each case detected by the control device 1 and a correspondingly adapted charging time calculated for the individual ignition.

What is claimed is:

1. An ignition system for an internal combustion engine, comprising:

a control device for controlling a flow of current in at least one ignition coil;

the control device repeatedly connecting and disconnecting a primary current from the at least one ignition coil to spark a plurality of individual ignitions of a sequential spark ignition, wherein each connection of the primary current to the at least one ignition coil signifies a starting of a charging process for a corresponding one of the plurality of individual ignitions and each disconnection of the primary current from the at least one ignition coil signifies a closing of the charging process for the corresponding one of the plurality of individual ignitions, a charging process time for the corresponding one of the plurality of individual ignitions being a difference between a time of the closing of the charging process for the corresponding one of the plurality of individual ignitions and a time of the starting of the charging process for the corresponding one of the plurality of individual ignitions; and the control device determining a distribution limit and determining a charging process time for a final ignition of the plurality of individual ignitions, the control device subtracting the charging process time for the final ignition of the plurality of individual ignitions from the distribution limit to obtain another limit, the control device inhibiting the starting of the charging process for any one of the plurality of individual ignitions after the another limit is reached.

2. The ignition system according to claim 1, wherein the ignition system is for an internal combustion engine with a rotating distribution, and wherein the distribution limit corresponds to a crankshaft angle, the crankshaft angle corresponding to a possible ignition spark in a next cylinder in a sequence of the plurality of individual ignitions.

3. The ignition system according to claim 1, wherein the ignition system is for an internal combustion engine with a stationary distribution, and wherein the distribution limit corresponds to a crankshaft angle, the crankshaft angle corresponding to an exhaust stroke of a possible ignition spark in a present cylinder in a sequence of the plurality of individual ignitions.

4. The ignition system according to claim 1, further comprising a measuring device coupled to the control device for measuring the primary current in the at least one ignition coil, the control device interrupting the charging process of a corresponding one of the plurality of individual ignitions when the measured primary current reaches a predetermined reference value.

5. The ignition system according to claim 1, wherein the control device determines the closing time of the charging process for each individual ignition as a function of a supply voltage, wherein the closing time of the charging process for each individual ignition is inversely proportional to the supply voltage.

6. A method for controlling ignition in an internal combustion engine, comprising the steps of:

controlling a flow of current in at least one ignition coil by repeatedly connecting and disconnecting a primary current from the at least one ignition coil to spark a plurality of individual ignitions of a sequential spark ignition, wherein each connection of the primary current to the at least one ignition coil signifies a starting of a charging process for a corresponding one of the plurality of individual ignitions and each disconnection of the primary current from the at least one ignition coil signifies a closing of the charging process for the corresponding one of the plurality of individual ignitions, a charging process time for the corresponding one of the plurality of individual ignitions being a difference between a time of the closing of the charging process for the corresponding one of the plurality of individual ignitions and a time of the starting of the charging process for the corresponding one of the plurality of individual ignitions;

determining a distribution limit;

determining a charging process time for a final ignition of the plurality of individual ignitions;

subtracting the charging process time for the final ignition of the plurality of individual ignitions from the distribution limit to obtain another limit; and inhibiting the starting of the charging process for any one of the plurality of individual ignitions after the another limit is reached.

7. The method according to claim 6, wherein the ignition system is for an internal combustion engine with a rotating distribution, and wherein the distribution limit corresponds to a crankshaft angle, the crankshaft angle corresponding to a possible ignition spark in a next cylinder in a sequence of the plurality of individual ignitions.

8. The method according to claim 6, wherein the ignition system is for an internal combustion engine with a stationary distribution, and wherein the distribution limit corresponds to a crankshaft angle, the crankshaft angle corresponding to a possible ignition spark in an exhaust stroke of a present cylinder in a sequence of the plurality of individual ignitions.

9. The method according to claim 6, further including the steps of:

measuring the primary current in the at least one ignition coil; and interrupting the charging process of a corresponding one of the plurality of individual ignitions when the measured primary current reaches a predetermined reference value.

10. The method according to claim 6, wherein the determining step further includes determining the closing time of the charging process for each individual ignition as a function of a supply voltage, wherein the closing time of the charging process for each individual ignition is inversely proportional to the supply voltage.

* * * * *